United States Patent [19]

Anderson

[11] 4,238,664

[45] Dec. 9, 1980

[54] BURN-IN KNIFE WITH EDGE GUIDE

[76] Inventor: Wilfred P. Anderson, 4535 Blaisdale Ave., Minneapolis, Minn. 55409

[21] Appl. No.: 829,289

[22] Filed: Aug. 31, 1977

[51] Int. Cl.[3] ..... H05B 1/00; B26B 3/00; B26B 29/00

[52] U.S. Cl. ..... 219/230; 30/140; 30/286; 30/293; 219/533

[58] Field of Search ..... 219/221, 227–241, 219/533, 530; 30/140, 286, 293; 228/57; 83/171

[56] References Cited

U.S. PATENT DOCUMENTS

| | | | |
|---|---|---|---|
| 1,574,641 | 2/1926 | Christopherson | 30/293 |
| 1,616,544 | 2/1927 | Paolicelli et al. | 219/229 |
| 1,863,153 | 6/1932 | Christopherson | 30/293 |
| 2,032,688 | 3/1936 | Dart | 219/227 X |
| 2,097,811 | 11/1937 | Foley | 30/140 |
| 2,452,259 | 10/1948 | Pabis | 219/238 |
| 2,596,133 | 5/1952 | Donahue et al. | 228/57 X |
| 2,863,036 | 12/1958 | Mitchell et al. | 219/240 X |
| 3,085,330 | 4/1963 | Lewinski | 30/293 |
| 3,555,950 | 1/1971 | Gijsbers et al. | 219/229 X |
| 3,902,042 | 8/1975 | Goldfarb et al. | 30/140 X |

*Primary Examiner*—A. Bartis
*Attorney, Agent, or Firm*—Dean P. Edmundson

[57] ABSTRACT

A burn-in knife for furniture repair has an electrically heated blade and is provided with an adjustable edge guide assembly mounted on the knife handle for supporting the knife on a workpiece and maintaining the working edge of the blade at a predetermined distance from the workpiece. The guide assembly includes a heat-insulative guide means arranged in side-by-side relationship to the working edge of the blade and out of the working path thereof. The guide means lies in the same plane as the blade and has a straight edge adapted to engage the workpiece. The guide means is selectively adjustable both vertically and rotationally relative to the working edge of the blade.

8 Claims, 6 Drawing Figures

BURN-IN KNIFE WITH EDGE GUIDE

BACKGROUND OF THE INVENTION

This invention relates to burn-in knives of the type commonly used in wooden furniture repair techniques.

A common technique for repairing chipped, gouged, or dented furniture involves the placement of hard plastic in the gouge, dent or depression in the wood in order to restore a smooth surface which may then be finished so as to look like the remainder of the wooden furniture. Typical of hard plastics used for this purpose are "No-Lift Stick", commercially available from Mohawk Finishing Products Inc., "NU GLO" patching stick, commercially available from Star Chemical Co., and common shellac stick. These materials are high-melting (e.g. 300° F.–400° F.) thermoplastics which are sold in stick or rod form.

Placement and working of the hard plastic in the gouge, dent, or depression in the furniture is typically effected by means of a burning-in knife (sometimes referred to as a "burn-in" knife). One type of burn-in knife is rather simple, having only an insulated handle (typically made of wood) and a blade having a working edge (which is generally a straight edge). This type of knife is brought to working temperature by placing the blade portion in a small furnace until it reaches the desired temperature.

Another type of burn-in knife is very similar in appearance to the first type except that it contains means permitting the blade to be electrically heated. For example, the knife may contain an electrical resistance heater which heats the blade in much the same manner as a soldering iron may be heated.

Both of the foregoing types of burn-in knives are conventional in the field and are available commercially, for example, from Mohawk Finishing Products, Inc.

The heated blade of the burn-in knife (whichever type of knife is used) is used to both (a) melt an appropriate amount of plastic from a plastic stick or rod, and (b) smooth the melted plastic into the gouge, dent or depression to be repaired. The smoothing step, in its final stages, is effected by supporting a portion of the working edge of the hot blade of the knife on the undamaged portion of the furniture adjacent to the damaged portion so that the melted plastic will be smoothed out level with the undamaged portion of the furniture. Thus, a portion of the working edge of the blade must also serve as an edge guide for the knife. This is necessary so that the repaired portion will not be out of the plane of the undamaged portion of the furniture.

A major disadvantage of such burn-in knives is that it is not possible to accurately and smoothly repair gouges, dents or depressions which are wider than the working edge of the blade of the knife. Also, when only a small portion of the working edge of the blade is functioning as an edge guide (i.e. resting on the undamaged portion of the furniture) extreme care must be exercised by the workman to maintain the working edge of the blade at a constant height over the melted plastic in the damaged portion so that no variations result in the finished plastic surface. There is also the danger of burning through the finish in the undamaged portion of the furniture adjacent to the portion being repaired. Care must also be taken to bring the knife down very gradually to the furniture surface while maintaining continuous horizontal motion of the knife.

There is the further danger of interfering with previously repaired portions of the furniture if such repaired portions are adjacent to as-yet unrepaired portions. In such cases it is extremely difficult, if not impossible, to rest a portion of the hot edge of a blade on such a surface for guiding purposes.

Consequently, in view of the difficulties associated with the use of conventional burn-in knives there has been a great need for improvements in such burn-in knives. The present invention provides such improvements.

THE PRESENT INVENTION

In accordance with the present invention there is provided an improved burn-in knife comprising:

(a) insulated handle means, (b) a blade, carried by said handle means, having a working edge, (c) an edge guide mounted on said knife, said edge guide carrying on its lower portion a guide means which is adapted to support said knife on a workpiece and maintain said working edge of said knife at a predetermined distance from said workpiece.

In one embodiment of the invention the edge guide is pivotably mounted on the knife so that it may be rotated away from the blade (e.g. to facilitate cleaning of the blade or to permit heating of the blade in an oven). In another embodiment the edge guide is adjustable both vertically and rotationally relative to the working edge of the blade.

The improved burn-in knives of the present invention avoid the many problems associated with the use of conventional burn-in knives. For example, the edge guide permits a burn-in knife to be used safely to repair much wider gouges, dents and depressions than previously possible because the entire working edge of the hot blade may be used for its intended purpose (i.e. to smooth out the melted plastic in the portion of the furniture being repaired). Furthermore, since the edge guide is not heated, and since the working edge of the blade is supported in a controlled manner, there is no danger of harming the undamaged portion of the furniture or previously completed repairs while repairing the damaged portion with the hot blade of the burn-in knife, so long as the knife is kept moving. Even this precaution is unnecessary except in the final stages of the smoothing process because most of the repair work is performed with the blade slightly higher than the surface being repaired.

DETAILED DESCRIPTION OF THE INVENTION

The invention will be described in more detail hereinafter with reference to the accompanying drawings wherein like reference characters refer to the same parts throughout the several views and in which.

Figure 1:
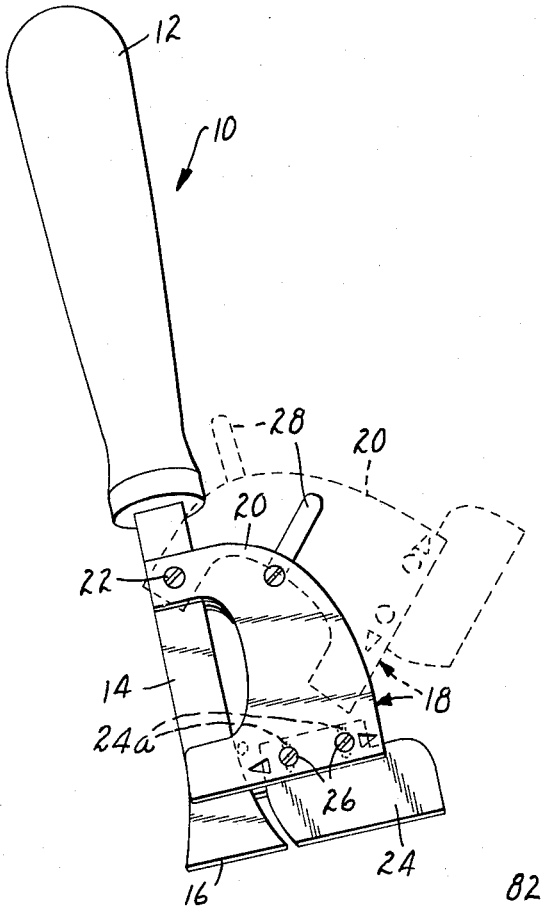
FIG. 1 is a side view of one embodiment of an improved burn-in knife of the invention.

Thus, in FIG. 1 there is shown burn-in knife 10 comprising insulated handle means 12, blade 14 having a working edge 16, and edge guide 18. Edge guide 18 comprises mounting assembly 20 which is mounted to blade 14 near the upper end thereof by means of pin 22. On the lower portion of assembly 20 is carried guide means 24 which is adjacent to the working edge of the blade and is adapted to support the knife on a workpiece and maintain the working edge 16 of knife 10 at a predetermined distance from a workpiece. Guide means 24 is preferably attached to assembly 20 by means of screws 26 extending transversely through holes in assembly 20. By loosening screws 26, guide means 24 may be moved vertically (because of slot-shaped holes 24*a* in guide means 24) so as to adjust its position relative to the working edge 16 of knife 10.

Edge guide 18 may be easily rotated away from blade 14, pivoting around pin 22. Lever 28 facilitates such movement when desired by the user of such knife. When edge guide 18 is pivoted away from the blade of knife 10, the blade may be easily inserted into a conventional furnace in order to heat it in preparation for performing a repair on furniture or the like.

Figure 6:
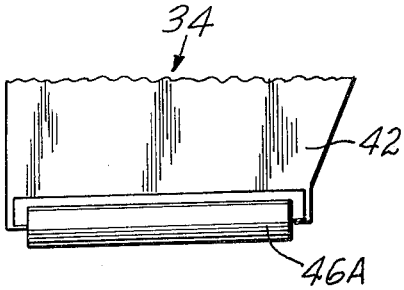
FIG. 6 illustrates another embodiment of a guide means useful in this invention.

Preferably, edge guide 18 is made of a heat-insulative material such as masonite or heat-resistant plastic or the like. Preferably, guide means 24 has a straight bottom edge and is preferably composed of a heat-resistant plastic. Preferably, guide means 24 is sufficiently rigid to support the knife without undue flexing. Guide means 24 may also comprise at least one rotatable member such as a roller 46*a* (see FIG. 6) or a plurality of small wheels mounted on edge guide 18.

Figure 2:
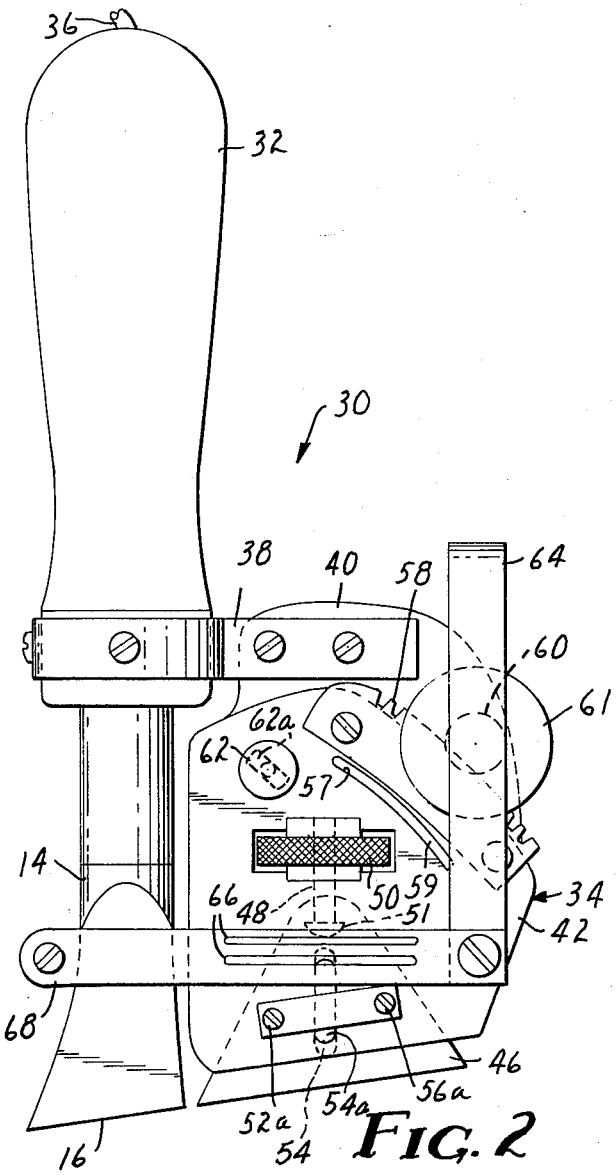
FIG. 2 is a side view of another embodiment of an improved burn-in knife of the invention.
Figure 4:
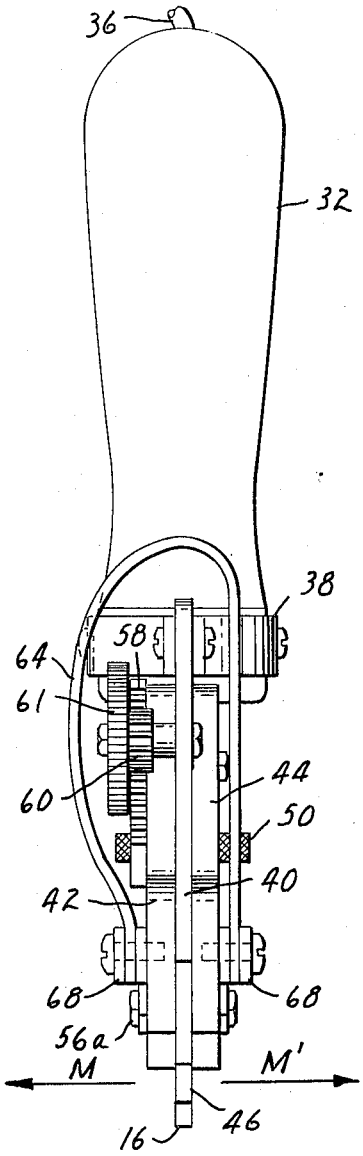
FIG. 4 is an edge view of the embodiment of FIG. 2.
Figure 3:
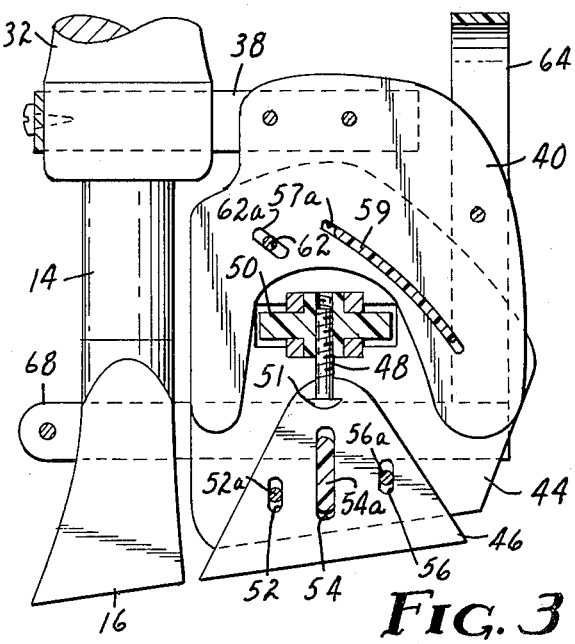
FIG. 3 is a side view of the embodiment of FIG. 2 after removal of one face of the edge guide assembly.

In FIGS. 2, 3 and 4 there is shown another embodiment of the invention. Thus, there is shown burn-in knife 30 comprising insulated handle means 32, blade 14 having a working edge 16, edge guide assembly 34, and electrical power cord 36 for bringing power to an electrical resistance heater (not shown) within knife 30 for heating blade 14 to operating temperature. In this embodiment edge guide assembly 34 comprises a bracket 38 securely attached to knife 30, a mounting plate 40 securely attached to bracket 38, two side plates 42 and 44 mounted on mounting plate 40, and guide means 46 adapted to support the knife on a workpiece as the knife is moved in the directions indicated by arrows M and M′ in FIG. 4. In addition, this embodiment has means to adjust the vertical position of guide means 46 relative to the working edge 16 of knife 30. Guide means 46 is adjacent to the working edge of the blade. Threaded member 48 is threaded into nut 50 at one end and the bottom end 51 is a flattened head which mechanically engages the top portion of guide means 46. Nut 50 is supported on side plates 42 and 44; accordingly, when nut 50 is turned in one direction or the other, threaded member 48 is caused to move either upward or downward, thereby causing guide means 46 to move upwardly or downwardly relative to blade edge 16. Slots 52, 54 and 56 in guide means 46 are engaged by screws or pins 52*a* and 56*a* and insert 54*a* so as to maintain the proper alignment of guide means 46 as it is caused to move upwardly or downwardly. Insert 54*a* is secured to the side plates 42 and 44 and it travels in slot 54 in guide means 46 when the guide means 46 is raised or lowered. Insert 54 provides additional controlled guidance for guide means 46 when it is raised or lowered. Screws 52*a* and 56*a* do not provide sufficient controlled guidance of guide means 46 by themselves. Screws 52*a* and 56*a* may be tightened in order to resist up and down movement of the guide means.

Guide means 46 may also be rotationally adjusted by means of a rack 58 and pinion 60 arrangement which causes edge guide 46 to move rotationally with respect to blade 14. Rack 58 is attached securely to side plate 42 and pinion 60 (carried by wheel 61) is attached to mounting plate 40. Slots 57 in side plates 42 and 44 engage projection or insert 59 which passes through a longer slot 57*a* of similar shape in mounting plate 40. Slot 57*a* serves to form a path for the rotational movement of the side plates 42 and 44 upon operation of the rack and pinion mechanism. Accordingly, plates 42 and 44 pivot on an arc defined by slot 57*a*. Insert 59 is secured to the side plates 42 and 44 so that the relative position of side plates 42 and 44 is maintained the same when they are moved arcuately (by means of the rack and pinion mechanism) along a path defined by insert 59 moving in a longer slot 57*a* in mounting plate 40. A tightening screw 62 which extends through both side plates (and through slot 62 in plate 40) is present so that the two side plates 42 and 44 may be tightened as firmly as necessary against mounting plate 40 which is located between the side plates. The proper setting of screw 62 prevents undesired rotational movement of edge guide 18 during actual use of knife 30 and yet allows rotational adjustments to be made when necessary without resetting of the screw. Screw 62 may move with plates 42 and 44 because of a slot in mounting plate 40.

To help facilitate use of this embodiment of the burn-in knife there may also be included another handle means 64. If desired, grooves or channels 66 may be present on side bars 68, to which handle 64 is fastened, to further facilitate holding of the burn-in knife by the operator during operations. Side bars 68 are not rigidly or immovably attached to blade 14 in such a manner as to prevent rotational movement of side plates 42 and 44. Rather side bars 68 are connected as shown in such a manner as to simply prevent the guide means from being twisted laterally and to provide an additional means for an operator to grip the tool near the bottom thereof as shown in the drawings. If desired, handle 32 and bracket 38 may be covered with conventional insulating material to prevent discomfort to the operator's hand during operation.

Figure 5:
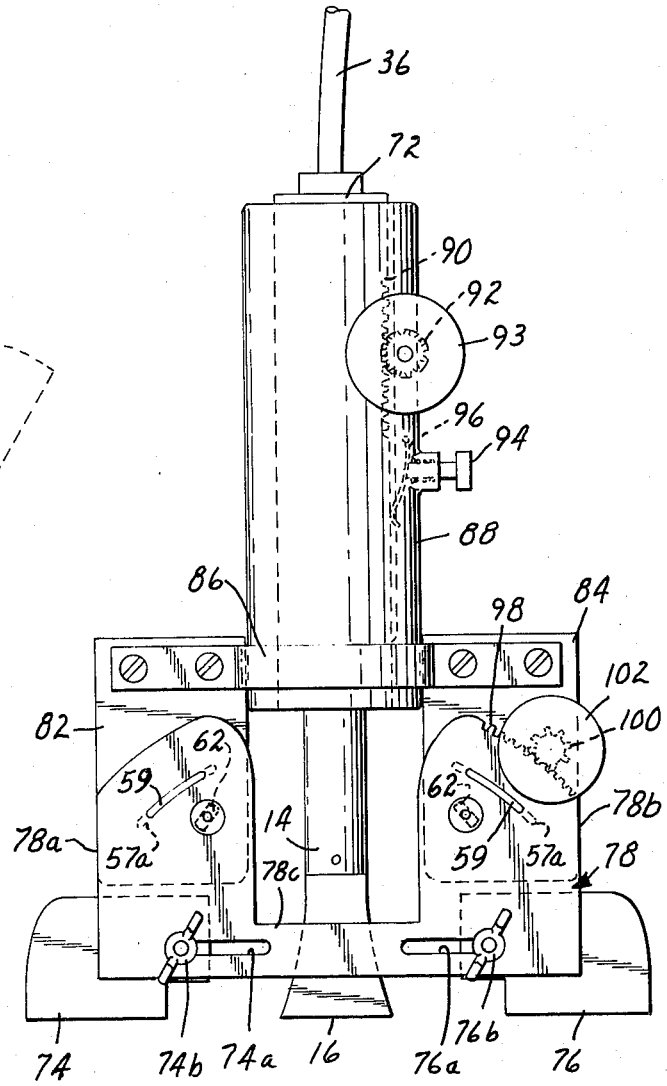
FIG. 5 is a side view of still another embodiment of the invention.

In FIG. 5 there is shown another embodiment of a burn-in knife 70 comprising handle means 72, power cord 36 leading to an electrical resistance heater (not shown) within knife 70, blade 14 having a working edge 16, and two guide means 74 and 76. In this embodiment the guide means are carried between a pair of side plates (similar to those shown at 42 and 44 in FIGS. 2–4). Front side plate 78 is shown in FIG. 5 and the rear side plate (not shown) is of the same configuration. As shown in the drawing, side plate 78 is attached to mounting plates 82 and 84, respectively by means of arms 78*a* and 78*b* which are connected by bridging member 78*c*. The rear side plate is attached to the mounting plates 82 and 84 in the same manner. The mounting plates are securely attached to bracket 86, which in turn is fastened to sleeve 88. Sleeve 88 is adapted to move vertically relative to handle 72 and blade 14 by means of rack 90, mounted on handle 72, and pinion 92 (carried by wheel 93), mounted on sleeve 88. The vertical adjustment may also be effected by means of a double gear arrangement such that turning of one gear provides for gross movement of sleeve 88 relative to handle 72 while turning of the other gear provides for fine adjustment. Such double gear arrangements are well known in the art for other devices where it is desired to have a gross adjustment and a fine adjustment mechanism.

Screw 94 may be turned in so as to urge spring clip 96 against handle 72 to prevent undesired vertical movement during use of the knife and to adjust for any slack or play due to thermal expansion during operation.

Rotational movement of guide means 74 and 76 is effected by means of rack 98 (carried on side plate 78) and pinion 100 (carried on wheel 102) attached to mounting plate 84. Horizontal adjustment of guide means 74 and 76 is effected by means of channels or slots 74*a* and 76*a*, respectively, in side plates 78 and 80 in which screws 74*b* and 76*b* may slide after being loosened. Rack 98 and pinion 100 adjusts both guide means 74 and 76. Plate 78 is mounted on one end to mounting plate 84 by means of insert 59 carried in arcuate slot 57*a* and is mounted at the other end to mounting plate 82 in the same manner. The mechanism of insert 59 and slot 57*a* is the same as shown in FIGS. 2–4 and as described previously in the specification. Similarly, tightening screws 62 operate in the same manner as described in connection with FIGS. 2–4.

Of course, the embodiment shown in FIG. 5 may be provided with an edge guide assembly on only one side of the blade 14 instead of on both sides of blade 14 as presently shown. Similarly, the vertical adjustment means shown in FIG. 5 may also be used in the embodiment shown in FIGS. 2, 3 and 4.

The embodiments shown in the drawings show the use of a conventional handle for the knife, but it is recognized that the knives of the present invention would work equally as well without conventional handles so long as the blade of the knives is rigidly secured with respect to the edge guide and there is a means for the operator to hold and control the knife. In such cases, the handle comprises both the edge guide and the means for the operator to hold and control the knife.

Other variants will be readily apparent to those skilled in the art without departing from the scope of the present invention.

What is claimed is:

1. A burn-in knife comprising:

(a) insulated handle means, (b) a heated blade, carried by such handle means, having a straight working edge, (c) an edge guide mounted on said knife, said edge guide carrying on its lower portion a guide means of heat-insulative material which is in adjacent side-by-side relationship to the working edge of said blade and out of the working path thereof, said guide means having a straight edge adapted to engage the surface of a workpiece and being adapted to support said knife on a workpiece and maintain said working edge of said knife at a predetermined distance from said workpiece, and said edge guide including means for selectively adjusting the edge of said guide means vertically with respect to said working edge of said blade without changing the angle of said working edge of said blade with respect to the edge of said guide means, and wherein said guide means lies in the same plane as said blade.

2. A burn-in knife comprising:

(a) insulated handle means, (b) a blade, carried by said handle means, having a straight working edge, (c) means for electrically heating said blade, and (d) an edge guide assembly mounted on said knife, said edge guide assembly comprising:

(i) a guide means of heat-insulative material which is in adjacent side-by-side relationship to the working edge of said blade and out of the working path thereof, said guide means having a straight edge adapted to engage the surface of a workpiece and being adapted to support said knife on a workpiece and maintain said working edge of said knife at a predetermined distance from said workpiece, (ii) vertical adjustment means for selectively raising or lowering the edge of said guide means relative to said working edge of said blade without changing the angle of said working edge of said blade with respect to the edge of said guide means, said guide means lying in the same plane as said blade, and (iii) rotational adjustment means adapted to rotate the edge of said guide means in said plane relative to said working edge of said blade.

3. A burn-in knife in accordance with claim 2, wherein the straight edge of said guide means is defined by a roller which is adapted to engage the surface of a workpiece.

4. A burn-in knife in accordance with claim 2, wherein said edge guide assembly further comprises:

(iv) a bracket securely attached to said knife, (v) a mounting plate securely attached to said bracket, said mounting plate being disposed laterally of said handle means and said blade, (vi) two spaced apart side plates pivotally mounted on said mounting plate;

wherein said guide means is carried between said two side plates for pivotal movement therewith, and wherein said rotational adjustment means comprises a manually adjustable rack and pinion mechanism on said mounting plate and said side plates for pivoting said side plates and said guide means carried thereby relative to said mounting plate whereby the angular position of the edge of said guide means with respect to said working edge of said blade can be selectively adjusted, and wherein said vertical adjustment means of said edge guide assembly includes means on said side plates for vertically adjusting the position of said guide means relative to said working edge of said blade.

5. A burn-in knife in accordance with claim 4, wherein said vertical adjustment means comprises means mounting said guide means for vertical movement between said side plates, and includes a threaded member mounted at one end to said guide means and having its other end threaded through a threaded nut rotatably captured between said side plates.

6. A burn-in knife in accordance with claim 2, wherein said edge guide assembly is vertically adjustable as a unit relative to said insulated handle means.

7. A burn-in knife in accordance with claim 6, wherein said edge guide assembly comprises two of said guide means, one of said guide means being mounted adjacent one side of said blade and the other of said guide means being mounted adjacent the opposite side of said blade.

8. A burn-in knife in accordance with claim 6, wherein said edge guide assembly is vertically adjustable as a unit relative to said handle means by means of a rack and pinion, wherein said rack is attached to said handle means and said pinion is attached to a sleeve over said handle means, and wherein said edge guide assembly is attached to said sleeve.

* * * * *